US012583493B2

(12) United States Patent
Qiao et al.

(10) Patent No.: US 12,583,493 B2
(45) Date of Patent: Mar. 24, 2026

(54) AUTOMATIC ADJUSTMENT METHOD FOR TRAIN OPERATION DIAGRAM, STORAGE MEDIUM, AND ELECTRONIC DEVICE

(71) Applicant: CASCO SIGNAL LTD., Shanghai (CN)

(72) Inventors: Yongtao Qiao, Shanghai (CN); Chiyue Liu, Shanghai (CN); You Sun, Shanghai (CN)

(73) Assignee: CASCO SIGNAL LTD., Shanghai (CN)

( * ) Notice: Subject to any disclaimer, the term of this patent is extended or adjusted under 35 U.S.C. 154(b) by 29 days.

(21) Appl. No.: 18/720,545

(22) PCT Filed: Nov. 11, 2022

(86) PCT No.: PCT/CN2022/131337
§ 371 (c)(1),
(2) Date: Jun. 14, 2024

(87) PCT Pub. No.: WO2023/116252
PCT Pub. Date: Jun. 29, 2023

(65) Prior Publication Data

US 2025/0050924 A1 Feb. 13, 2025

(30) Foreign Application Priority Data

Dec. 21, 2021 (CN) ..... 202111572559.8

(51) Int. Cl.
*B61L 27/14* (2022.01)
*B61L 27/16* (2022.01)

(52) U.S. Cl.
CPC ..... *B61L 27/14* (2022.01); *B61L 27/16* (2022.01)

(58) Field of Classification Search
CPC ..... B61L 27/12; B61L 27/14; B61L 27/16
USPC ..... 701/19, 20
See application file for complete search history.

(56) References Cited

FOREIGN PATENT DOCUMENTS

| | | | |
|---|---|---|---|
| CN | 112319557 | A | 2/2021 |
| CN | 112660209 | A | 4/2021 |
| CN | 113665640 | A | 11/2021 |
| CN | 114044031 | A | 2/2022 |

(Continued)

*Primary Examiner* — Hai H Huynh
(74) *Attorney, Agent, or Firm* — Bayramoglu Law Offices LLC

(57) ABSTRACT

An automatic adjustment method includes: drawing a closing symbol in case of emergency during train operation, and determining a closed section for adjusting a train operation diagram and adjustment conditions for the operation diagram by the closing symbol; obtaining a train set to be adjusted based on the adjustment conditions for the operation diagram; obtaining a train with failure in the closed section, and registering resource occupancy based on the closing symbol and the train with failure in the closed section to generate a resource occupancy list; performing station track adjustment and calculation, arrival and departure time adjustment and calculation, and section operation time adjustment and calculation on each train in the train set to be adjusted based on the resource occupancy in the resource occupancy list, and obtaining a corresponding adjustment result; and applying the adjustment result of each train to a corresponding planned line in the operation diagram.

14 Claims, 2 Drawing Sheets

(56) References Cited

FOREIGN PATENT DOCUMENTS

| | | | | | |
|---|---|---|---|---|---|
| CN | 114312926 A | * | 4/2022 | ..... | Y02T 10/40 |
| JP | 2011-131636 A | | 7/2011 | | |

* cited by examiner

AUTOMATIC ADJUSTMENT METHOD FOR TRAIN OPERATION DIAGRAM, STORAGE MEDIUM, AND ELECTRONIC DEVICE

CROSS-REFERENCE AND RELATED APPLICATION

This application is a National Stage of International Application No. PCT/CN2022/131337 filed on Nov. 11, 2022, which claims priority to Chinese Patent Application No. 202111572559.8 filed on Dec. 21, 2021. Both of the aforementioned applications are hereby incorporated by reference in their entireties.

TECHNICAL FIELD

The present disclosure relates to the technical field of train dispatching, in particular to an automatic adjustment method for a train operation diagram, a storage medium, and an electronic device.

BACKGROUND

The centralized traffic control (CTC) system for high-speed railway has become a very important train operation apparatus in the high-speed (intercity) railway, and is a core of dispatching command and train operation. The stability, availability, security and convenience of the system directly affect the efficiency of dispatching command.

A train operation plan will be affected in case of emergency such as sudden failure of a section and sudden failure of station equipment, and thus needs to be adjusted. However, it is difficult for manual operation to ensure high dispatching efficiency in short-time emergency dispatching of multiple train numbers and multiple stations. Therefore, it is particularly important to implement rapid adjustment of the train plan, ensure reasonable plan adjustment in emergency, and improve the emergency disposal efficiency.

SUMMARY

The present disclosure aims to solve one of the technical problems in related technologies at least to a certain extent. In view of this, a first objective of the present disclosure is to provide an automatic adjustment method for a train operation diagram, which can ensure reasonable plan adjustment in emergency and improve the emergency disposal efficiency of train operation.

A second objective of the present disclosure is to provide a computer-readable storage medium.

A third objective of the present disclosure is to provide an electronic device.

To achieve the above objective, the present disclosure is implemented by the following technical solution:

An automatic adjustment method for a train operation diagram includes: drawing a closing symbol in case of emergency during train operation, and determining a closed section for adjusting a train operation diagram and adjustment conditions for the operation diagram by the closing symbol; obtaining a train set to be adjusted based on the adjustment conditions for the operation diagram; obtaining a train with failure in the closed section, and registering resource occupancy based on the closing symbol and the train with failure in the closed section to generate a resource occupancy list; performing station track adjustment and calculation, arrival and departure time adjustment and calculation, and section operation time adjustment and calculation on each train in the train set to be adjusted based on the resource occupancy in the resource occupancy list, and obtaining a corresponding adjustment result; and applying the adjustment result of each train to a corresponding planned line in the operation diagram, so as to complete automatic adjustment of the operation diagram.

In one embodiment, the method further includes: after the adjustment result of each train is applied to the corresponding planned line in the operation diagram, an operation result after application is further updated to the resource occupancy list.

In one embodiment, the adjustment conditions for the operation diagram include one or any combination of a train adjustment time range, a train access station sequence, a line district involved in adjustment, and station track change of a station.

In one embodiment, the operation of obtaining a train set to be adjusted based on the adjustment conditions for the operation diagram specifically includes: obtaining the train adjustment time range from the adjustment conditions for the operation diagram, and obtaining the train set to be adjusted based on the train adjustment time range.

In one embodiment, the method further includes: determining an adjustment priority of each train in the train set to be adjusted, sequencing each train in the train set to be adjusted based on the adjustment priority, and sequentially performing station track adjustment and calculation, arrival and departure time adjustment and calculation, and section operation time adjustment and calculation on each train in the train set to be adjusted based on a sequence obtained by sequencing.

In one embodiment, the operation of determining an adjustment priority of each train in the train set to be adjusted includes: obtaining access time information, access station information, and access entrance and exit information of each train in the train set to be adjusted in the closed section; and calculating the adjustment priority based on the access time information, the access station information, and the access entrance and exit information of each train in the closed section.

In one embodiment, before station track adjustment and calculation, arrival and departure time adjustment and calculation, and section operation time adjustment and calculation are performed on each train in the train set to be adjusted based on the resource occupancy in the resource occupancy list, the method further includes: obtaining an operation time point of each train, and obtaining a train adjustment time range from the adjustment conditions for the operation diagram; and determining an adjustment starting station, an adjustment finishing station, an adjustment starting position, and an adjustment finishing position for a train operation line corresponding to each train based on the operation time point and the train adjustment time range.

In one embodiment, the adjustment starting position or the adjustment finishing position includes a station entrance, a station track, a station exit, and a departure section.

In one embodiment, the resource occupancy includes resource occupancy of the station entrance, resource occupancy of the station track, resource occupancy of the station exit, and resource occupancy of the departure section.

In one embodiment, the operation of performing station track adjustment and calculation, arrival and departure time adjustment and calculation, and section operation time adjustment and calculation on each train in the train set to be adjusted based on the resource occupancy in the resource occupancy list includes: sequentially checking the resource occupancy of the station entrance, the resource occupancy of the station track, the resource occupancy of the station exit, and the resource occupancy of the departure section from the adjustment starting position of the adjustment starting station to the adjustment finishing position of the adjustment finishing station for each train; and performing station track adjustment and calculation, arrival and departure time adjustment and calculation, and section operation time adjustment and calculation on the train based on the resource occupancy of the station entrance, the resource occupancy of the station track, the resource occupancy of the station exit, and the resource occupancy of the departure section.

In one embodiment, the operation of performing station track adjustment and calculation, arrival and departure time adjustment and calculation, and section operation time adjustment and calculation on the train based on the resource occupancy of the station entrance, the resource occupancy of the station track, the resource occupancy of the station exit, and the resource occupancy of the departure section includes: performing arrival and departure time adjustment and calculation on the train based on the resource occupancy of the station entrance and the resource occupancy of the station exit; performing station track adjustment and calculation on the train based on the resource occupancy of the station track; and performing section operation time adjustment and calculation on the train based on the resource occupancy of the departure section.

In one embodiment, arrival and departure time includes arrival time and departure time of the train at the current adjusted station, and the operation of performing arrival time adjustment and calculation on the train based on the resource occupancy of the station entrance includes: obtaining the arrival time of the train at the current adjusted station, and checking the resource occupancy of the entrance of the current adjusted station based on the arrival time; and calculating adjusted arrival time of the current adjusted station based on the checked resource occupancy of the entrance, and proceeding to operation of performing station track adjustment and calculation on the train based on the resource occupancy of the station track when the adjusted arrival time meets a preset arrival time requirement.

In one embodiment, the operation of performing station track adjustment and calculation on the train based on the resource occupancy of the station track includes: obtaining a planned station track and an arrival and departure mode of the train at the current adjusted station, and checking the resource occupancy of the station track of the current adjusted station based on the planned station track and the arrival and departure mode; and calculating whether the station track needs to be adjusted based on the checked resource occupancy of the station track, adjusting the station track when the station track needs to be adjusted, and proceeding to operation of performing departure time adjustment and calculation on the train based on the resource occupancy of the station exit when a station track adjustment result meets a preset station track adjustment requirement.

In one embodiment, the operation of performing departure time adjustment and calculation on the train based on the resource occupancy of the station exit includes: obtaining the departure time of the train at the current adjusted station, and checking the resource occupancy of the exit of the current adjusted station based on the departure time; and calculating adjusted departure time of the current adjusted station based on the checked resource occupancy of the exit, and proceeding to operation of performing section operation time adjustment and calculation on the train based on the resource occupancy of the departure section when the adjusted departure time meets a preset departure time requirement.

In one embodiment, the operation of performing section operation time adjustment and calculation on the train based on the resource occupancy of the departure section includes: obtaining the departure time and planned section operation time of the train at the current adjusted station, checking the resource occupancy of the departure section of the current adjusted station based on the departure time and the section operation time, and performing section operation time adjustment and calculation on the train based on the checked resource occupancy of the departure section.

To achieve the above objective, a second aspect of the present disclosure provides a computer-readable storage medium, having a computer program stored thereon, where when the computer program is executed by a processor, the above automatic adjustment method for a train operation diagram is implemented.

To achieve the above objective, a third aspect of the present disclosure provides an electronic device, including a processor and a memory, where the memory has a computer program stored thereon, and when the computer program is executed by the processor, the above automatic adjustment method for a train operation diagram is implemented.

The present disclosure has at least the following technical effects:

According to the present disclosure, the closed section for adjusting the train operation diagram is determined by the drawn closing symbol in case of emergency during train operation; the train with failure in the closed section is obtained; the resource occupancy is registered based on the closing symbol and the train with failure in the closed section; the station track adjustment and calculation, the arrival and departure time adjustment and calculation, and the section operation time adjustment and calculation are performed on the train requiring emergency dispatching based on the registered resource occupancy to obtain the corresponding calculation and adjustment result; and the adjustment result is applied to the corresponding planned line in the operation diagram, such that automatic adjustment and avoidance of the train may be implemented, and batch train avoidance operations can be implemented, thereby effectively ensuring reasonable plan adjustment in emergency, and improving the emergency disposal efficiency of train operation.

DETAILED DESCRIPTION OF THE EMBODIMENTS

The present disclosure is further described in detail below with reference to the drawings and specific embodiments.

The advantages and features of the present disclosure are clearer according to description and claims below. It is to be noted that the drawings in a quite simplified form with an inaccurate ratio are merely used for describing objectives of the embodiments of the present disclosure in an assistant manner conveniently and clearly.

An automatic adjustment method for a train operation diagram, a storage medium, and an electronic device in the embodiments are described below with reference to the drawings.

Figure 1:
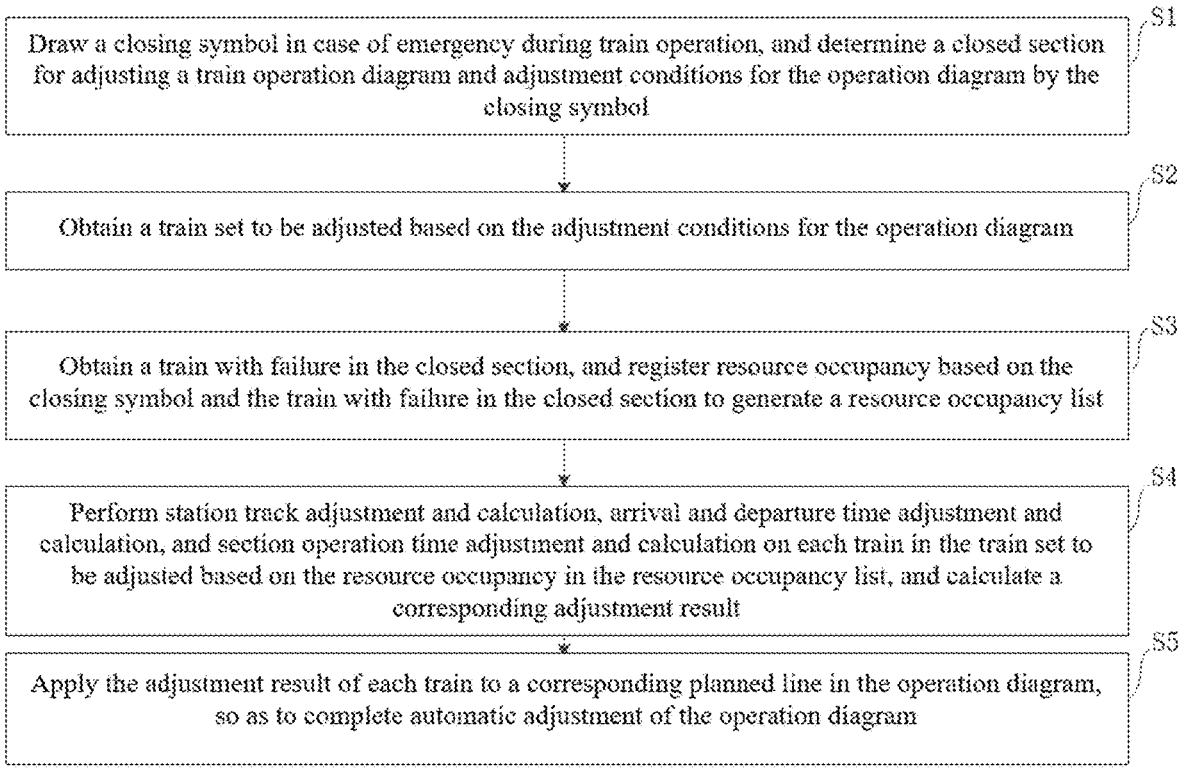
FIG. 1 is a flowchart of an automatic adjustment method for a train operation diagram according to an embodiment of the present disclosure.

FIG. 1 is a flowchart of an automatic adjustment method for a train operation diagram provided by an embodiment of the present disclosure. As shown in FIG. 1, the method includes the following operations.

In operation S1, a closing symbol is drawn in case of emergency during train operation, and a closed section for adjusting a train operation diagram and adjustment conditions for the operation diagram are determined by the closing symbol.

Specifically, in case of emergency such as failure of section equipment and failure of station equipment during train operation, the closing symbol of construction needs to be drawn first to determine the closed section such as a closed district or a closed station, and the adjustment conditions for the train operation diagram are determined. The closing symbol includes information of the closed station, a closing time period, and a closing direction. The closed station includes first and last stations in the closed section; the closing time period includes start time and end time of closing; and the closing direction is an up, down, or up-down direction in which train operation is not allowed. The train operation diagram is an operation plan diagram of a train operating in a railway section and at a time point of arriving at, departing from or passing through a station. In this embodiment, the train requiring emergency dispatching may be selected by the determined closed section or adjustment conditions for the train operation diagram.

In one embodiment of the present disclosure, the adjustment conditions for the operation diagram include one or any combination of a train adjustment time range, a train access station sequence, a line district involved in adjustment, and station track change of the station.

Figure 2:
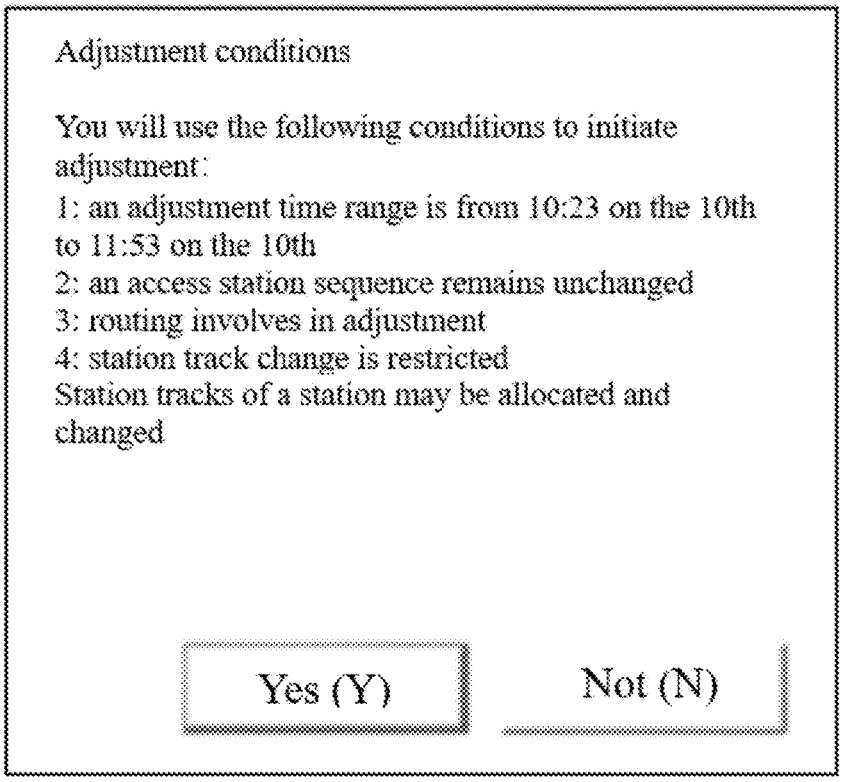
FIG. 2 is a schematic constitutional diagram of adjustment conditions for an operation diagram according to an embodiment of the present disclosure.

As shown in FIG. 2, the determined adjustment conditions for the train operation diagram include a set adjustment time range, an access station sequence, and a line district involved in adjustment such as a routing district, and the station track of the station is set to be changeable.

In operation S2, a train set to be adjusted is obtained based on the adjustment conditions for the operation diagram.

The operation of obtaining a train set to be adjusted based on the adjustment conditions for the operation diagram specifically includes: obtaining the train adjustment time range from the adjustment conditions for the operation diagram, and obtaining the train set to be adjusted based on the train adjustment time range.

In this embodiment, it is possible to obtain an operation time point of each train, then analyze all trains requiring emergency dispatching and whose operation time points are affected based on the obtained train adjustment time range, and form the train set to be adjusted.

In operation S3, a train with failure in the closed section is obtained, and resource occupancy is registered based on the closing symbol and the train with failure in the closed section to generate a resource occupancy list.

In this embodiment, the resource occupancy may be registered based on the closing symbol on the operation diagram within the adjustment time range and the train with failure in the closed section, where the resource occupancy includes resource occupancy of a station entrance, resource occupancy of a station track, resource occupancy of a station exit, and resource occupancy of a departure section. In this embodiment, the resource occupancy of each station in the closed section may be obtained by the resource occupancy list.

In operation S4, station track adjustment and calculation, arrival and departure time adjustment and calculation, and section operation time adjustment and calculation are performed on each train in the train set to be adjusted based on the resource occupancy in the resource occupancy list, and a corresponding adjustment result is calculated.

Before the adjustment and calculation are performed, the method further includes: determining an adjustment priority of each train in the train set to be adjusted, sequencing each train in the train set to be adjusted based on the adjustment priority, and sequentially performing station track adjustment and calculation, arrival and departure time adjustment and calculation, and section operation time adjustment and calculation on each train in the train set to be adjusted based on a sequence obtained by sequencing.

The operation of determining an adjustment priority of each train in the train set to be adjusted includes:

obtaining access time information, access station information, and access entrance and exit information of each train in the train set to be adjusted in the closed section; and calculating the adjustment priority based on the access time information, the access station information, and the access entrance and exit information of each train in the closed section.

In one embodiment of the present disclosure, before station track adjustment and calculation, arrival and departure time adjustment and calculation, and section operation time adjustment and calculation are performed on each train in the train set to be adjusted based on the resource occupancy in the resource occupancy list, the method further includes: obtaining an operation time point of each train, and obtaining a train adjustment time range from the adjustment conditions for the operation diagram; and determining an adjustment starting station, an adjustment finishing station, an adjustment starting position, and an adjustment finishing position for a train operation line corresponding to each train based on the operation time point and the train adjustment time range. The adjustment starting position or the adjustment finishing position includes the station entrance, the station track, the station exit, and the departure section. The station is a current adjusted station.

Specifically, after the train set to be adjusted is obtained based on the adjustment time range determined by a dispatcher, the adjustment starting station, the adjustment finishing station, the adjustment starting position, and the adjustment finishing position for each train may be calculated based on a relationship between the operation time point of each train in the train set to be adjusted and the set adjustment time range.

In one embodiment of the present disclosure, the operation of performing station track adjustment and calculation, arrival and departure time adjustment and calculation, and section operation time adjustment and calculation on each train in the train set to be adjusted based on the resource occupancy in the resource occupancy list includes: sequentially checking the resource occupancy of the station entrance, the resource occupancy of the station track, the resource occupancy of the station exit, and the resource occupancy of the departure section from the adjustment starting position of the adjustment starting station to the adjustment finishing position of the adjustment finishing station for each train; and performing station track adjustment and calculation, arrival and departure time adjustment and calculation, and section operation time adjustment and calculation on the train based on the resource occupancy of the station entrance, the resource occupancy of the station track, the resource occupancy of the station exit, and the resource occupancy of the departure section.

The adjustment starting position of the adjustment starting station represents that the train starts to be adjusted from a position of a station; and the adjustment finishing position of the adjustment finishing station represents that the adjustment is finished when the train is adjusted to a position of a station.

In this embodiment, single train adjustment and calculation may be performed by a single train adjustment and calculation module. Specifically, the train set to be adjusted may be traversed, and the station track adjustment and calculation, the arrival and departure time adjustment and calculation, and the section operation time adjustment and calculation may be performed on the train by the single train adjustment and calculation module based on the resource occupancy of the entrance, the resource occupancy of the station track, the resource occupancy of the exit, and the resource occupancy of the departure section of the current adjusted station. After the current adjusted station is adjusted and calculated, a next adjusted station is entered, and station track adjustment and calculation, arrival and departure time adjustment and calculation, and section operation time adjustment and calculation are performed on the train based on resource occupancy of an entrance, resource occupancy of a station track, resource occupancy of an exit, and resource occupancy of a departure section of the next adjusted station. In this way, the station track adjustment, the arrival and departure time adjustment, and the section operation time adjustment of each train from the adjustment starting position of the adjustment starting station to the adjustment finishing position of the adjustment finishing station may be completed.

In one embodiment of the present disclosure, the operation of performing station track adjustment and calculation, arrival and departure time adjustment and calculation, and section operation time adjustment and calculation on the train based on the resource occupancy of the station entrance, the resource occupancy of the station track, the resource occupancy of the station exit, and the resource occupancy of the departure section includes: performing arrival and departure time adjustment and calculation on the train based on the resource occupancy of the station entrance and the resource occupancy of the station exit; performing station track adjustment and calculation on the train based on the resource occupancy of the station track; and performing section operation time adjustment and calculation on the train based on the resource occupancy of the departure section.

Arrival and departure time includes arrival time and departure time of the train at the current adjusted station, and the operation of performing arrival time adjustment and calculation on the train based on the resource occupancy of the station entrance includes:

obtaining the arrival time Ta of the train at the current adjusted station STAn, and checking the resource occupancy of the entrance of the current adjusted station STAn based on the arrival time Ta; and calculating adjusted arrival time Ta1 of the current adjusted station STAn based on the checked resource occupancy of the entrance, and proceeding to operation of performing station track adjustment and calculation on the train based on the resource occupancy of the station track when the adjusted arrival time Ta1 meets a preset arrival time requirement.

When the adjusted arrival time Ta1 does not meet the preset arrival time requirement, it is possible to return to a previous adjusted station STAn−1 and modify departure time Td of the train at the previous adjusted station STAn−1 to Td1 based on access time Taccess of the current adjusted station STAn calculated and recommended by a system, and repeat the operation of performing arrival time adjustment and calculation on the train based on the resource occupancy of the station entrance at the previous adjusted station STAn−1.

In one embodiment of the present disclosure, the operation of performing station track adjustment and calculation on the train based on the resource occupancy of the station track includes: obtaining a planned station track and an arrival and departure mode of the train at the current adjusted station STAn, and checking the resource occupancy of the station track of the current adjusted station STAn based on the planned station track and the arrival and departure mode; and calculating whether the station track needs to be adjusted based on the checked resource occupancy of the station track, adjusting the station track when the station track needs to be adjusted, and proceeding to operation of performing departure time adjustment and calculation on the train based on the resource occupancy of the station exit when a station track adjustment result meets a preset station track adjustment requirement.

When the station track adjustment result does not meet the preset station track adjustment requirement, it is possible to return to the previous adjusted station STAn−1 and modify the departure time Td of the train at the previous adjusted station STAn−1 to Td1 based on the access time Taccess of the current adjusted station STAn calculated and recommended by the system, and repeat the operation of performing arrival time adjustment and calculation on the train based on the resource occupancy of the station entrance at the previous adjusted station STAn−1.

In one embodiment of the present disclosure, the operation of performing departure time adjustment and calculation on the train based on the resource occupancy of the station exit includes: obtaining the departure time of the train at the current adjusted station STAn, and checking the resource occupancy of the exit of the current adjusted station STAn based on the departure time; and calculating adjusted departure time of the current adjusted station STAn based on the checked resource occupancy of the exit, and proceeding to operation of performing section operation time adjustment and calculation on the train based on the resource occupancy of the departure section when the adjusted departure time meets a preset departure time requirement.

In one embodiment of the present disclosure, the operation of performing section operation time adjustment and calculation on the train based on the resource occupancy of the departure section includes:

obtaining the departure time Td and planned section operation time $\Delta T_{run}$ of the train at the current adjusted station STAn, checking the resource occupancy of the departure section of the current adjusted station STAn based on the departure time Td and the section operation time $\Delta T_{run}$, and performing section operation time adjustment and calculation on the train based on the checked resource occupancy of the departure section.

Specifically, when there is the closing symbol in the departure section and a departure route of the train has been triggered, handled, or occupied, the system may stop the train in the departure section until end time Tobt of the closing symbol and adjust arrival time of the train at the next adjusted station STAn+1 based on a stop duration, then the next adjusted station STAn+1 is entered, and the operation of performing arrival time adjustment and calculation on the train based on the resource occupancy of the station entrance is repeated at the next adjusted station STAn+1. When there is the closing symbol in the departure section and the departure route of the train has not been handled, the train may be stopped at the station based on the end time Tobt of the closing symbol, then the departure time Td of the current adjusted station STAn is adjusted to Td1, and then the operation of performing arrival time adjustment and calculation on the train based on the resource occupancy of the station entrance is repeated for the current adjusted station STAn.

When there is no closing symbol in the departure section, the adjustment may be performed based on other resource occupancies such as the resource occupancy of the station entrance. In this embodiment, when the resource occupancy of the departure section does not meet a departure requirement, the departure time Td of the current adjusted station STAn needs to be adjusted to Td1, and then the operation of performing arrival time adjustment and calculation on the train based on the resource occupancy of the station entrance is repeated for the current adjusted station STAn. When the departure requirement is met, the arrival time of the train at the next adjusted station STAn+1 is modified based on the corresponding adjustment result, then the next adjusted station STAn+1 is entered, and the operation of performing arrival time adjustment and calculation on the train based on the resource occupancy of the station entrance is repeated for the next adjusted station STAn+1.

After the single train adjustment and calculation module traverses the station track adjustment and calculation, the arrival and departure time adjustment and calculation, and the section operation time adjustment and calculation from the adjustment starting position of the adjustment starting station to the adjustment finishing position of the adjustment finishing station, single train adjustment is finished.

In operation S5, the adjustment result of each train is applied to a corresponding planned line in the operation diagram, so as to complete automatic adjustment of the operation diagram.

Figure 3:
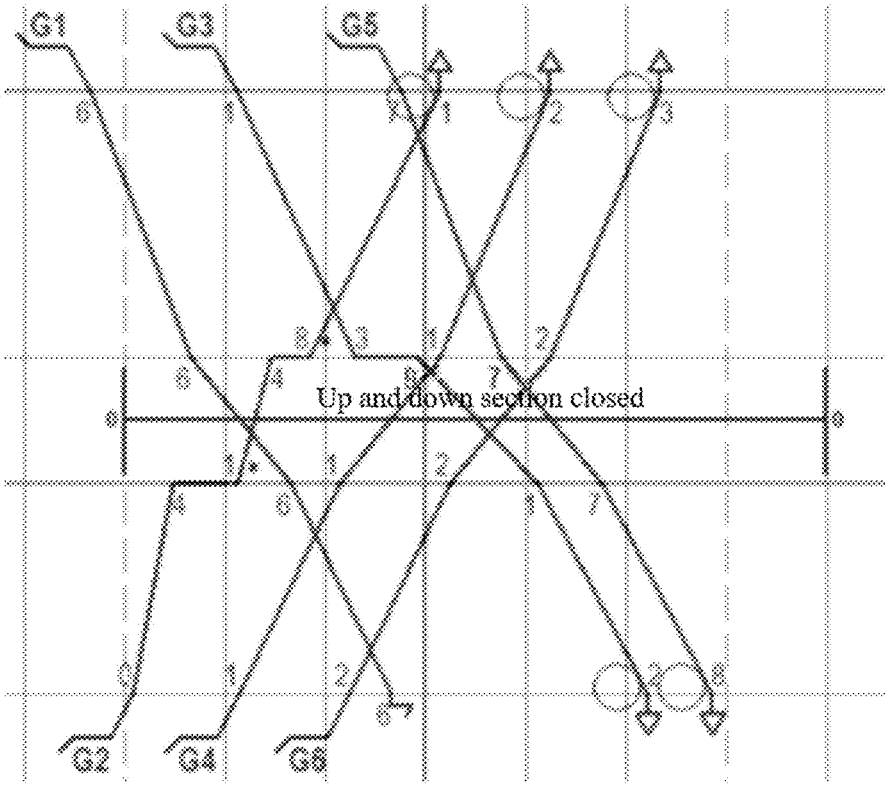
FIG. 3 is an operation diagram before automatic adjustment of a train plan according to an embodiment of the present disclosure.
Figure 4:
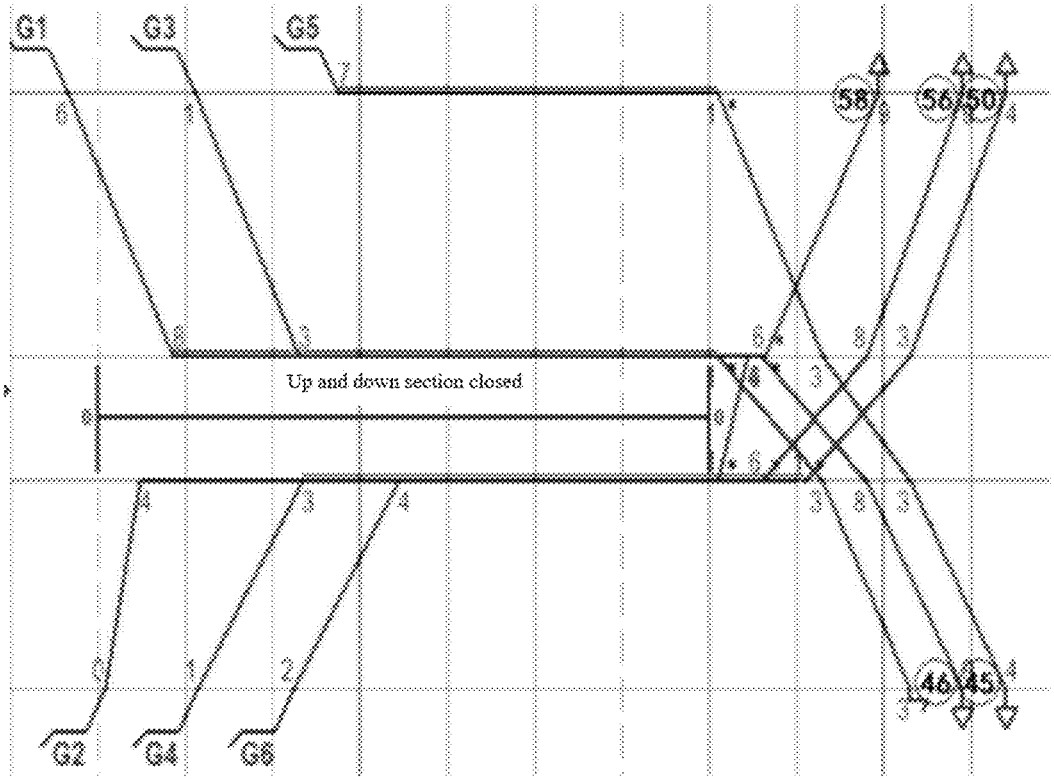
FIG. 4 is an operation diagram after automatic adjustment of a train plan according to an embodiment of the present disclosure.

Specifically, a single train adjustment result may be allocated to the operation line. For example, the adjustment of the arrival and departure time, the station track, and the departure section may be performed on arrival and departure points of the adjusted station requiring train adjustment in an operation line adjustment module. In this embodiment, after the adjustment result of each train is applied to the corresponding planned line in the operation diagram, an operation result after application may be further updated to the resource occupancy list, so as to update the resource occupancy list in real time. FIG. 3 is an operation diagram before automatic adjustment of a train plan. FIG. 4 is an operation diagram after automatic adjustment of a train plan. As shown in FIG. 4, each train in the operation diagram undergoes corresponding operation plan adjustment by the automatic adjustment method for the operation diagram in this embodiment, thus effectively improving the emergency disposal efficiency of train operation.

In summary, according to the present disclosure, the closed section for adjusting the train operation diagram is determined by the drawn closing symbol in case of emergency during train operation; the train with failure in the closed section is obtained; the resource occupancy is registered based on the closing symbol and the train with failure in the closed section; the station track adjustment and calculation, the arrival and departure time adjustment and calculation, and the section operation time adjustment and calculation are performed on the train requiring emergency dispatching based on the registered resource occupancy to obtain the corresponding calculation and adjustment result; and the adjustment result is applied to the corresponding planned line in the operation diagram, such that the affected train may be automatically adjusted based on resource registration of the closing symbol in each time period, automatic adjustment and avoidance of the train may be implemented, the station track of the train can be reasonably allocated, and batch train avoidance operations can be implemented, thereby effectively ensuring reasonable plan adjustment in emergency, and improving the emergency disposal efficiency of train operation.

Further, the present disclosure provides a computer-readable storage medium, having a computer program stored thereon, where when the computer program is executed by a processor, the above automatic adjustment method for a train operation diagram is implemented.

Further, the present disclosure provides an electronic device, including a processor and a memory, where the memory has a computer program stored thereon, and when the computer program is executed by the processor, the above automatic adjustment method for a train operation diagram is implemented.

While the content of the present disclosure has been described in detail with the above preferred embodiments, it is to be recognized that the above description should not be considered as a limitation to the present disclosure. Various modifications and alternatives to the present disclosure will become apparent to those skilled in the art upon reading the above content. Therefore, the scope of protection of the present disclosure shall be limited by the appended claims.

The invention claimed is:

1. An automatic adjustment method for a train operation diagram for operating a train set, comprising:

drawing a closing symbol in the train operation diagram in case of an emergency during a high-speed railway train operation, and determining a closed section for adjusting the train operation diagram and adjustment conditions for the train operation diagram based on the closing symbol; wherein the adjustment conditions for the operation diagram comprise one or any combination of a train adjustment time range, a train access station sequence, a line district involved in adjustment, and station track change of a station;

obtaining the train set to be adjusted based on the adjustment conditions for the train operation diagram, the train set comprising one or more trains;

determining an adjustment priority of each train of the train set to be adjusted; and sequencing each train of the train set to be adjusted based on the adjustment priority;

obtaining a train of the train set with a failure in the closed section, and registering resource occupancy based on the closing symbol and the train with the failure in the closed section to generate a resource occupancy list;

for each train of the train set to be adjusted, based on a sequence obtained by sequencing, sequentially performing a station track adjustment and calculation, an arrival time and a departure time adjustment and calculation, and a section operation time adjustment and calculation based on the resource occupancy in the resource occupancy list, and calculating a corresponding adjustment result; wherein the resource occupancy comprises resource occupancy of the station entrance, resource occupancy of the station track, resource occupancy of the station exit, and resource occupancy of the departure section;

applying the corresponding adjustment result of each train of the train set to a corresponding planned line in the train operation diagram, so as to complete an automatic adjustment of the train operation diagram to generate an adjusted train operation diagram; and operating the train set according to the adjusted train operation diagram.

2. The automatic adjustment method for the train operation diagram according to claim 1, further comprising:

after applying the corresponding adjustment result of each train of the train set to the corresponding planned line in the train operation diagram, updating an operation result after application to the resource occupancy list.

3. The automatic adjustment method for a train operation diagram according to claim 1, wherein the obtaining the train set to be adjusted based on the adjustment conditions for the train operation diagram comprises:

obtaining the train adjustment time range from the adjustment conditions for the train operation diagram, and obtaining the train set to be adjusted based on the train adjustment time range.

4. The automatic adjustment method for the train operation diagram according to claim 1, wherein the determining the adjustment priority of each train of the train set to be adjusted comprises:

obtaining access time information, access station information, and access entrance and exit information of a train subset of the train set to be adjusted in the closed section, the the train subset comprising one or more trains from the train set; and calculating the adjustment priority based on the access time information, the access station information, and the access entrance and exit information of the train subset of the train set in the closed section.

5. The automatic adjustment method for the train operation diagram according to claim 1, wherein before, for each train of the train set to be adjusted, the performing the station track adjustment and calculation, the arrival time and the departure time adjustment and calculation, and the section operation time adjustment and calculation based on the resource occupancy in the resource occupancy list, the method further comprises:

obtaining an operation time point of each train, and obtaining a train adjustment time range from the adjustment conditions for the train operation diagram; and determining an adjustment starting station, an adjustment finishing station, an adjustment starting position, and an adjustment finishing position for a train operation line corresponding to each train based on the operation time point and the train adjustment time range.

6. The automatic adjustment method for the train operation diagram according to claim 5, wherein the adjustment starting position or the adjustment finishing position comprises a station entrance, a station track, a station exit, and a departure section.

7. The automatic adjustment method for the train operation diagram according to claim 6, wherein, for each train of the train set to be adjusted, the performing the station track adjustment and calculation, the arrival time and the departure time adjustment and calculation, and the section operation time adjustment and calculation based on the resource occupancy in the resource occupancy list comprises:

for each train of the train set to be adjusted, sequentially checking the resource occupancy of the station entrance, the resource occupancy of the station track, the resource occupancy of the station exit, and the resource occupancy of the departure section from the adjustment starting position of the adjustment starting station to the adjustment finishing position of the adjustment finishing station for each train; and performing the station track adjustment and calculation, the arrival time and the departure time adjustment and calculation, and the section operation time adjustment and calculation on a train based on the resource occupancy of the station entrance, the resource occupancy of the station track, the resource occupancy of the station exit, and the resource occupancy of the departure section.

8. The automatic adjustment method for the train operation diagram according to claim 7, wherein the performing the station track adjustment and calculation, the arrival time and the departure time adjustment and calculation, and the section operation time adjustment and calculation on the train based on the resource occupancy of the station entrance, the resource occupancy of the station track, the resource occupancy of the station exit, and the resource occupancy of the departure section comprises:

performing the arrival time and the departure time adjustment and calculation on the train based on the resource occupancy of the station entrance and the resource occupancy of the station exit;

performing the station track adjustment and calculation on the train based on the resource occupancy of the station track; and performing the section operation time adjustment and calculation on the train based on the resource occupancy of the departure section.

9. The automatic adjustment method for the train operation diagram according to claim 8, wherein the arrival time and the departure time comprises an arrival time and a departure time of the train at a current adjusted station, and the performing the arrival time adjustment and calculation on the train based on the resource occupancy of the station entrance comprises:

obtaining the arrival time of the train at the current adjusted station, and checking the resource occupancy of the entrance of the current adjusted station based on the arrival time; and calculating an adjusted arrival time of the current adjusted station based on the checked resource occupancy of the entrance, and proceeding to the performing the station track adjustment and calculation on the train based on the resource occupancy of the station track when the adjusted arrival time meets a preset arrival time requirement.

10. The automatic adjustment method for the train operation diagram according to claim 9, wherein the performing the station track adjustment and calculation on the train based on the resource occupancy of the station track comprises:

obtaining a planned station track and an arrival and departure mode of the train at the current adjusted station, and checking the resource occupancy of the station track of the current adjusted station based on the planned station track and the arrival and departure mode; and calculating whether the station track needs to be adjusted based on the checked resource occupancy of the station track, adjusting the station track when the station track needs to be adjusted, and proceeding to the performing the departure time adjustment and calculation on the train based on the resource occupancy of the station exit when a station track adjustment result meets a preset station track adjustment requirement.

11. The automatic adjustment method for the train operation diagram according to claim 10, wherein the performing the departure time adjustment and calculation on the train based on the resource occupancy of the station exit comprises:

obtaining the departure time of the train at the current adjusted station, and checking the resource occupancy of the exit of the current adjusted station based on the departure time; and calculating adjusted departure time of the current adjusted station based on the checked resource occupancy of the exit, and proceeding to the performing the section operation time adjustment and calculation on the train based on the resource occupancy of the departure section when the adjusted departure time meets a preset departure time requirement.

12. The automatic adjustment method for the train operation diagram according to claim 11, wherein the performing the section operation time adjustment and calculation on the train based on the resource occupancy of the departure section comprises:

obtaining the departure time and a planned section operation time of the train at the current adjusted station, checking the resource occupancy of the departure section of the current adjusted station based on the departure time and the section operation time, and performing the section operation time adjustment and calculation on the train based on the checked resource occupancy of the departure section.

13. A computer-readable storage medium, having a computer program stored thereon, wherein when the computer program is executed by a processor, cause the processor to:

draw a closing symbol in the train operation diagram in case of an emergency during a high-speed railway train operation, and determine a closed section for adjusting the train operation diagram and adjustment conditions for the train operation diagram based on the closing symbol; wherein the adjustment conditions for the operation diagram comprise one or any combination of a train adjustment time range, a train access station sequence, a line district involved in adjustment, and station track change of a station;

obtain the train set to be adjusted based on the adjustment conditions for the train operation diagram, the train set comprising one or more trains;

determine an adjustment priority of each train of the train set to be adjusted; and sequence each train of the train set to be adjusted based on the adjustment priority;

obtain a train of the train set with a failure in the closed section, and register resource occupancy based on the closing symbol and the train with the failure in the closed section to generate a resource occupancy list;

for each train of the train set to be adjusted, based on a sequence obtained by sequencing, sequentially perform a station track adjustment and calculation, an arrival time and a departure time adjustment and calculation, and a section operation time adjustment and calculation based on the resource occupancy in the resource occupancy list, and calculate a corresponding adjustment result; wherein the resource occupancy comprises resource occupancy of the station entrance, resource occupancy of the station track, resource occupancy of the station exit, and resource occupancy of the departure section;

apply the corresponding adjustment result of each train of the train set to a corresponding planned line in the train operation diagram, so as to complete an automatic adjustment of the train operation diagram to generate an adjusted train operation diagram; and operate the train set according to the adjusted train operation diagram.

14. An electronic device, comprising:

a processor; and a memory coupled to the processor, wherein the memory has a computer program stored thereon, and when the computer program is executed by the processor, cause the processor to:

draw a closing symbol in the train operation diagram in case of an emergency during a high-speed railway train operation, and determine a closed section for adjusting the train operation diagram and adjustment conditions for the train operation diagram based on the closing symbol; wherein the adjustment conditions for the operation diagram comprise one or any combination of a train adjustment time range, a train access station sequence, a line district involved in adjustment, and station track change of a station;

obtain the train set to be adjusted based on the adjustment conditions for the train operation diagram, the train set comprising one or more trains;

determine an adjustment priority of each train of the train set to be adjusted; and sequence each train of the train set to be adjusted based on the adjustment priority;

obtain a train of the train set with a failure in the closed section, and register resource occupancy based on the closing symbol and the train with the failure in the closed section to generate a resource occupancy list;

for each train of the train set to be adjusted, based on a sequence obtained by sequencing, sequentially perform a station track adjustment and calculation, an arrival time and a departure time adjustment and calculation, and a section operation time adjustment and calculation based on the resource occupancy in the resource occupancy list, and calculate a corresponding adjustment result; wherein the resource occupancy comprises resource occupancy of the station entrance, resource occupancy of the station track, resource occupancy of the station exit, and resource occupancy of the departure section;

apply the corresponding adjustment result of each train of the train set to a corresponding planned line in the train operation diagram, so as to complete an automatic adjustment of the train operation diagram to generate an adjusted train operation diagram; and operate the train set according to the adjusted train operation diagram.

* * * * *